US006249229B1

(12) United States Patent
Eckstein et al.

(10) Patent No.: US 6,249,229 B1
(45) Date of Patent: Jun. 19, 2001

(54) ELECTRONIC ARTICLE SECURITY SYSTEM EMPLOYING VARIABLE TIME SHIFTS

(75) Inventors: Eric Eckstein, Merion Station, PA (US); John Davies, Sewell, NJ (US); Edwin Hopton, Philadelphia, PA (US); Nimesh Shah, Marlton, NJ (US); Bent Svendsen, Glen Mills, PA (US)

(73) Assignee: Checkpoint Systems, Inc., a Corp. of Pennsylvania, Thorofare, NJ (US)

( * ) Notice: Subject to any disclaimer, the term of this patent is extended or adjusted under 35 U.S.C. 154(b) by 0 days.

(21) Appl. No.: 09/374,655

(22) Filed: Aug. 16, 1999

(51) Int. Cl.[7] ..... G08B 13/14
(52) U.S. Cl. ..... 340/572.4; 340/551
(58) Field of Search ..... 340/572.4, 572.2, 340/572.1, 551, 10.2, 10.42, 10.51

(56) References Cited

U.S. PATENT DOCUMENTS

| | | | |
|---|---|---|---|
| 4,160,209 | 7/1979 | Thompson . | |
| 4,168,496 | 9/1979 | Lichtblau . | |
| 4,356,477 | 10/1982 | Vandebult . | |
| 4,476,459 | 10/1984 | Cooper et al. . | |
| 4,531,117 | 7/1985 | Nourse et al. . | |
| 4,609,911 | 9/1986 | Nourse et al. . | |
| 4,667,185 | 5/1987 | Nourse et al. . | |
| 4,745,401 | 5/1988 | Montean . | |
| 4,774,521 | 9/1988 | Okada et al. . | |
| 5,349,332 | 9/1994 | Ferguson et al. . | |
| 5,381,137 | 1/1995 | Ghaem et al. . | |
| 5,450,492 * | 9/1995 | Hook et al. | 340/572.4 |
| 5,463,376 * | 10/1995 | Stoffer | 340/551 |
| 5,495,229 * | 2/1996 | Balch et al. | 340/551 |
| 5,570,086 * | 10/1996 | Hanaoka et al. | 340/572.4 |

* cited by examiner

*Primary Examiner*—Daniel J. Wu
*Assistant Examiner*—John Tweel, Jr.
(74) *Attorney, Agent, or Firm*—Akin, Gump, Strauss, Hauer & Feld, L.L.P.

(57) ABSTRACT

A pulse-listen electronic article security (EAS) system for detecting the presence of a security tag within a detection zone is disclosed. The EAS system includes a transmitter for radiating a first electromagnetic signal into the detection zone. The first electromagnetic signal is a time sequence of RF bursts emitted during each of a plurality of contiguous frame intervals in which the duration of each of the frame intervals is one of a plurality of different values. The EAS system also includes a receiver synchronized with the transmitter for receiving a second electromagnetic signal re-radiated from a security tag in the detection zone in response to the first electromagnetic signal. The receiver provides an output signal if a security tag is detected. The values of the plurality of the frame interval durations are selected to be different from the values of frame interval durations of other EAS systems thereby rendering the EAS system substantially free of false alarms or blockages caused by the operation of other EAS systems.

23 Claims, 9 Drawing Sheets

TABLE FLUT

| BIN #(j) | GROUP ADDRESS (K) | | | |
|---|---|---|---|---|
| | 1 | 2 | -------- | 8 |
| 1 | C1,1 | C1,2 | -------- | C1,8 |
| 2 | C2,1 | C2,2 | -------- | C2,8 |
| ⋮ | ⋮ | ⋮ | ⋮ | ⋮ |
| 16 | C16,1 | C16,2 | | C16,8 |

*Fig. 3*

TABLE PLUT

| BIN #(j) | GROUP ADDRESS (K) | | | |
|---|---|---|---|---|
| | 1 | 2 | -------- | 8 |
| 1 | T1,1 | T1,2 | -------- | T1,8 |
| 2 | T2,1 | T2,2 | -------- | T2,8 |
| ⋮ | ⋮ | ⋮ | ⋮ | ⋮ |
| 16 | T16,1 | T16,2 | | T16,8 |

*Fig. 7*

TABLE JLUT

| STAGE # | GROUP ADDRESS (K) | | | | | | | |
|---|---|---|---|---|---|---|---|---|
| | 1 | 2 | 3 | 4 | 5 | 6 | 7 | 8 |
| 1 | | | | X | | X | X | X |
| 2 | X | | X | | X | | X | X |
| 3 | X | X | | X | | | | X |
| 4 | X | | | | | | | X |
| 5 | | X | X | X | X | | X | |
| 6 | | X | X | | X | X | X | X |
| 7 | | | | | | X | X | |
| 8 | X | X | X | X | X | X | X | X |

*Fig. 4*

ELECTRONIC ARTICLE SECURITY SYSTEM EMPLOYING VARIABLE TIME SHIFTS

BACKGROUND OF THE INVENTION

This present invention relates generally to electronic article security systems for detecting the presence of a security tag within a detection zone and more particularly to an improved pulse-listen electronic article security system employing pseudo-random frequency/time hopping RF bursts to provide a reduced false alarm rate.

The use of electronic article security (EAS) systems for detecting and preventing theft or unauthorized removal of articles or goods from retail establishments and/or other facilities such as libraries has become widespread. In general, such EAS systems employ a security tag, which is detectable by the EAS system and which is secured to the article to be protected. Such EAS systems are generally located at or around points of exit from such facilities to detect the security tag, and thus the article, as it transits through the exit point.

Due to environmental and regulatory considerations, individual EAS systems are generally effective over only a limited area in which a security tag attached to a protected article may be reliably detected. Such area, typically referred to as a detection zone, is generally limited to about six feet in width. While many stores and libraries have only a single exit doorway of a size commensurate with such a six foot wide detection zone, many other retail establishments have eight or ten exit doorways arranged side by side and may also have a multiplicity of separate exits. Furthermore, large mall stores frequently have a generally wide open area or aisle of ten feet or more in width serving as a connection with the mall. Thus, in many such situations, a plurality of EAS systems are required to fully protect either a multiplicity of separate exit points and/or individual exit/entrance points having an exit width greater than that which can be reliably protected by a single EAS system.

One type of EAS system which has gained widespread popularity utilizes a security tag which includes a self-contained passive resonant circuit in the form of a generally planar printed circuit which resonates at a predetermined frequency. Typically, an EAS system for detecting such a resonant circuit security tag includes a transmitter which transmits electromagnetic energy into the detection zone to form an electromagnetic field having frequency components proximate to the resonant frequency of the security tag. Such an EAS system also includes a receiver to detect the electromagnetic field within the detection zone. When an article having an attached security tag moves into or passes through the detection zone, the security tag is exposed to the transmitted electromagnetic energy, resulting in the security tag resonating to provide an output signal, thereby disturbing the electromagnetic field within the detection zone. Such disturbance is detectable by the receiver. The detection of such field disturbance by the receiver indicates the presence of an article with a security tag within the detection zone and the receiver activates an alarm to alert security or other personnel.

Because of the manufacturing techniques to produce them, the resonant frequency of a typical resonant security tag may vary by plus or minus ten percent or more from the nominal design resonant frequency of the tag. In order to reliably detect the presence of a security tag in the detection zone, EAS systems generally transmit a range of frequencies in order to ensure that a frequency component from the transmitted signal falls proximate to the resonant frequency of the security tag.

A popular type of EAS system, generally called a pulse-listen type EAS system, manufactured by Checkpoint Systems, Inc. of Thorofare, N.J. and known as the Strata™ System, repeatedly transmits a sequence of RF burst signals of electromagnetic energy at different frequencies such that the frequency of at least one of the bursts falls near the resonant frequency of a security tag to be detected. The EAS system gates the transmitter off between the bursts and enables the receiver during quiescent periods of time between the transmitter bursts. The receiver detects a security tag located within the detection zone by detecting the energy re-radiated by the resonant security tag during the quiescent periods.

Prior art pulse-listen EAS systems such as the Strata™ System provide for highly reliable detection of security tags within a detection zone by requiring that the receiver register a prescribed number of tag detections over a predetermined number of transmitted burst signal repetitions. However, where co-located EAS systems employ a common burst frequency/time pattern there is a potential for one EAS system to detect transmitted bursts from another EAS system, giving rise to undesired false alarms or reduced detection sensitivity. A satisfactory method for eliminating false alarms from co-located EAS systems, is to synchronize the transmitters of all co-located EAS systems to ensure that no transmitted burst overlaps the receive quiescent period of any receiver. A typical method of synchronization employs connecting cables between a single master EAS system and all other EAS systems which serve as slave systems. However, connecting cabling is costly and sometimes impractical to install. Alternatively, as described in U.S. Pat. No. 4,667,185, synchronization may be performed by wireless methods. However, wireless systems require additional complex synchronization circuitry. Additionally, synchronization is largely ineffective against interference from co-located EAS systems of other manufacturers and from other external interference.

The present invention eliminates the need for synchronization between co-located EAS systems by having each co-located EAS system utilize a distinct pseudo-random frequency/time pattern for interrogating security tags within an associated detection zone. By selecting the distinct frequency/time patterns such that the frequency/time patterns appear to be randomly distributed and have a cross correlation between themselves that is small, the probability of transmitter bursts from any EAS system causing a false alarm in any other co-located EAS system is extremely small. Further, because of the pseudo-random frequency/time pattern of reception the present invention provides a high degree of interference rejection to interfering signals generally.

BRIEF SUMMARY OF THE INVENTION

Briefly stated, the present invention provides a pulse-listen electronic article security (EAS) system for detecting the presence of a security tag within a detection zone. The EAS system includes a transmitter for radiating a first electromagnetic signal into the detection zone, the first electromagnetic signal being a time sequence of RF bursts emitted during each of a plurality of contiguous frame intervals, a duration of each of the frame intervals being one of a plurality of different values. The EAS system further includes a receiver synchronized with the transmitter for receiving a second electromagnetic signal re-radiated from a security tag in the detection zone in response to the first electromagnetic signal and providing an output signal if a security tag is detected, wherein the values of the plurality of the frame interval durations are selected to be different from the values of frame interval durations of other EAS systems thereby rendering the EAS system substantially free of false alarms or blockages caused by the operation of other EAS systems.

The present invention further provides a pulse-listen electronic article security (EAS) system for detecting the presence of a security tag within a detection zone. The EAS system includes a transmitter for radiating a first electromagnetic signal into the detection zone, the first electromagnetic signal being a time sequence of RF bursts, the frequency of the bursts being a plurality of values transmitted during each of a plurality of contiguous frame intervals, each frame interval comprising a sequence of bins each of which includes the RF burst, a noise receiving period, and a signal receiving period, each bin having a beginning and an end, the beginning of each successive bin being separated in time from the end of the previous bin by a plurality of values, the beginning of a first bin in each frame interval occurring at a predetermined time relative to a starting time of each frame interval. The EAS system further includes a receiver synchronized to the transmitter to be operative only during the noise receiving period and the signal receiving period of each bin for receiving a second electromagnetic signal re-radiated from the security tag in the detection zone in response to the first electromagnetic signal and providing an output signal if a security tag is detected, wherein a combination of the plurality of the burst frequencies and the bin separations is selected to be different from a combination of other burst frequencies and bin separations of other EAS systems thereby rendering the EAS system substantially free of false alarms or blockage caused by the operation of other co-located EAS systems.

The present invention also provides a pulse-listen electronic article security (EAS) system for detecting the presence of a security tag within a detection zone. The EAS system includes a transmitter for radiating a first electromagnetic signal into the detection zone, the first electromagnetic signal being a time sequence of RF bursts, the frequency of the bursts being a plurality of values transmitted during each of a plurality of contiguous frame intervals, a duration of each of the frame intervals being one of a plurality of values, each frame interval comprising a sequence of bins which includes the RF burst, a noise receiving period, and a signal receiving period, each bin having a beginning and an end, the beginning of each successive bin being separated in time from the end of the previous bin by a plurality of values, the beginning of a first bin in each frame interval occurring at a predetermined time relative to a starting time of each frame interval. The EAS system further includes a receiver synchronized to the transmitter to be operative only during the noise receiving period and the signal receiving period of each bin for receiving a second electromagnetic signal re-radiated from the security tag in the detection zone in response to the first electromagnetic signal and providing an output signal if the security tag is detected, wherein a combination of the plurality of the burst frequencies, the bin separations and the frame interval durations is selected to be different from a combination of other burst frequencies, bin separations and frame interval durations of other EAS systems thereby rendering the EAS system substantially free of false alarms or blockage caused by the operation of other co-located EAS systems.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 3 is a diagram of a frequency look up table, FLUT, according to the present invention;

FIG. 4 is a diagram of a frame look up table, JLUT, according to the present invention;

FIG. 7 is a diagram of a pulse look up table, PLUT, according to the second preferred embodiment of the present invention;

DETAILED DESCRIPTION OF THE INVENTION

Figure 1:
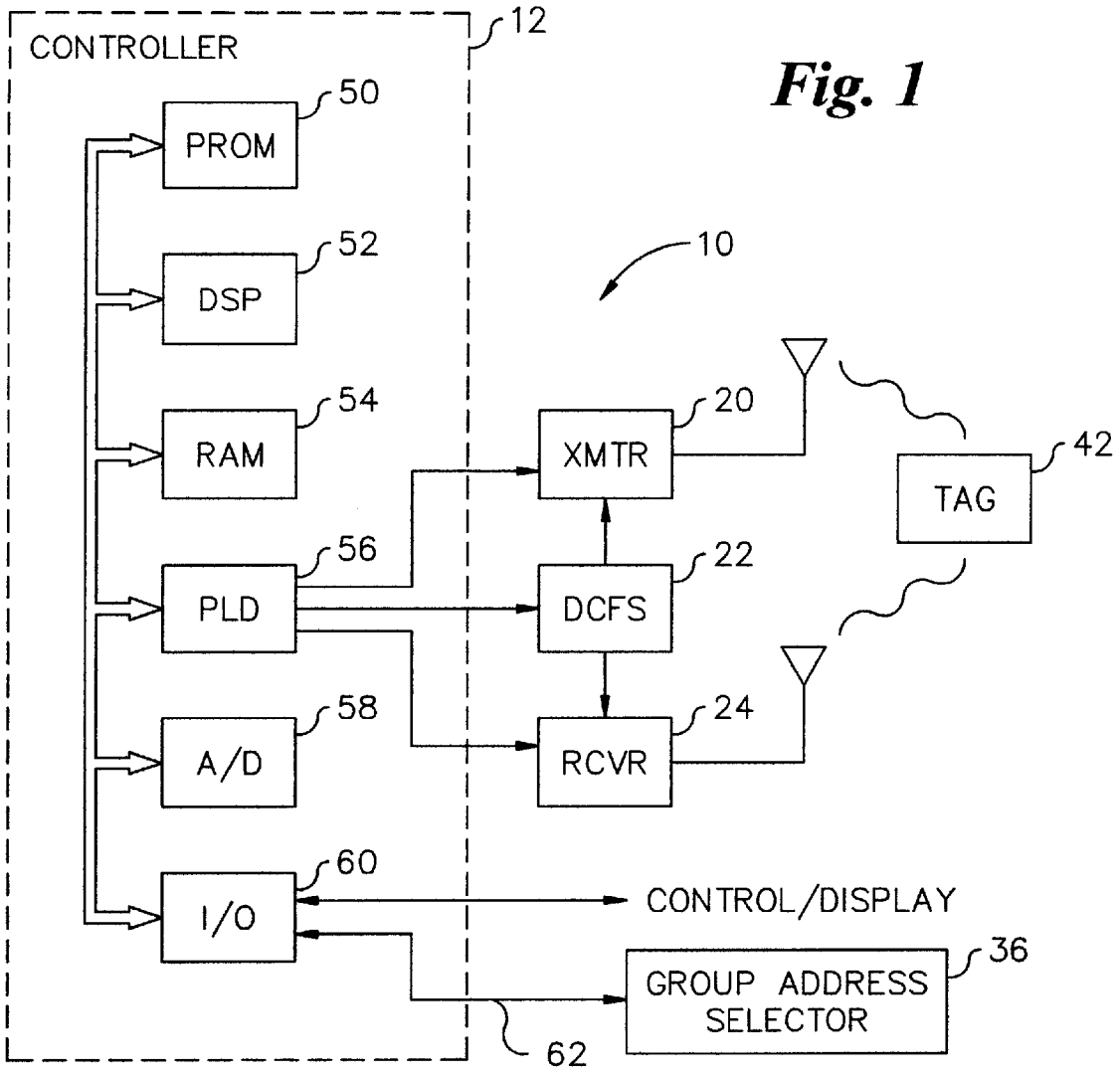
FIG. 1 is a functional block diagram of an EAS system according to a preferred embodiment of the present invention.

Referring to the drawings, where like numerals are used to indicate like elements throughout there is shown in FIG. 1 a functional block diagram of a pulse-listen EAS system 10 for detecting the presence of a security tag 42 within a detection zone according to the first preferred embodiment. The first preferred embodiment comprises a transmitter 20, including a transmitting antenna, for radiating a first electromagnetic signal into the detection zone; a receiver 24, including a receiving antenna, synchronized with the transmitter 20 for receiving a second electromagnetic signal re-radiated from the security tag 42 in the detection zone in response to the first electromagnetic signal and providing an output signal if a security tag 42 is detected; and a digitally controlled frequency synthesizer (DCFS) 22 for providing carrier output signals which tune the transmitter 20 to a transmitting frequency and tune the receiver 22 to a receiving frequency. The DCFS 22, transmitter 20 and receiver 24 are conventional in design and well known to those skilled in the art and need not be described for a complete understanding of the invention.

The first preferred embodiment also includes a controller 12 for determining the frequency of the carrier output signals of the DCFS 22 and for providing timing signals to the transmitter 20 and receiver 24 that determine the transmission and reception times. The controller 12 accepts a group address signal from a group address selector 36 for determining the specific time/frequency pattern to be employed. The controller also provides a control and display interface line 62 for exchanging data with external computing and display devices.

As further shown in FIG. 1, the controller 12 includes a digital signal processor (DSP) 52 for executing the principal control and computational tasks of the controller 12. The controller 12 also includes a programmable read only memory (PROM) 50 for storing a computer program and table data, a random access memory (RAM) 54 for storing temporary data, a programmable logic device (PLD) 56 for interfacing the controller 12 to the DCFS 22, transmitter 20 and receiver 24, an analog-to-digital converter 58 for accepting an analog output signal from the receiver 24 and inputting the digitized output signal from the receiver 24 into the controller 12, and an input/output device 60 for interfacing to the group address selector 36 and external control and display devices (not shown) along interface line 62.

The DSP 52 executes a program stored in the PROM 50 to generate control signals responsive to parameters also stored in the PROM 50. The PLD 56 tunes the DCFS 22 to the correct transmitting and receiving frequencies based upon the control signals received from the DSP 52 and activates the transmitter 20 and the receiver 24 during the transmission and reception time periods. As will be appreciated by those skilled in the art, the controller 12 structure is not limited to that disclosed in FIG. 1. For example, microprocessor chips or a single microchip, including software for implementing the function of some or all of the separate components shown in FIG. 1, would be suitable for use in the controller 12 and still be within the spirit and scope of the invention.

In the first preferred embodiment, the security tag 42 is of a type which is well known in the art of EAS systems having a resonant frequency within the detection range of the EAS system with which the tag 42 is employed. Preferably, the tag 42 has a circuit Q of between 50 and 100 and resonates at or near a frequency of 8.2 Megahertz, which is a resonant frequency commonly employed by EAS systems from a number of manufacturers. However, a security tag 42 having a resonant frequency of 8.2 MHZ. is not to be considered a limitation of the present invention. As will be appreciated by those skilled in the art, the EAS system 10 is suitable for operating at any frequency for which the EAS system is capable of establishing a suitable interaction between the transmitting and receiving antennas and the security tag 42.

Figure 2A:
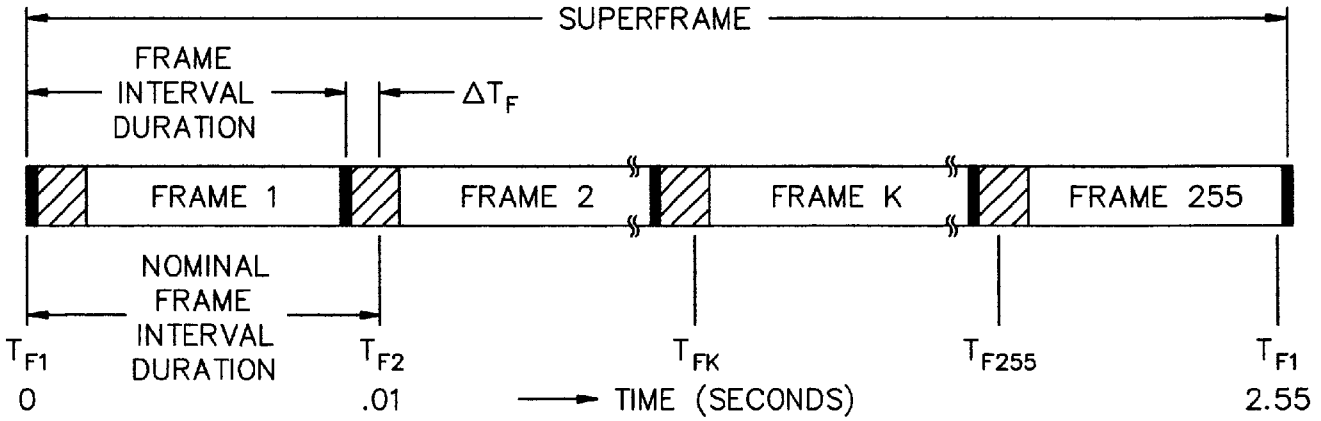
FIG. 2A is a timing diagram illustrative of the superframe signal structure utilized by a first preferred embodiment of the present invention.

As shown in FIG. 2A, the signal structure of EAS system 10 includes a fixed superframe repetition period of 255 contiguous frames. The superframe repetition period is established by counting 255 fixed duration nominal frame intervals, $T_{F2}-T_{F1}$, $T_{F3}-T_{F2}$ etc. However, as shown in FIG. 2A, each individual frame within a superframe repetition period has a different frame interval duration from every other frame within the superframe repetition period, deviating from the nominal frame interval duration by $+/-\Delta T_F$.

Figure 2B:
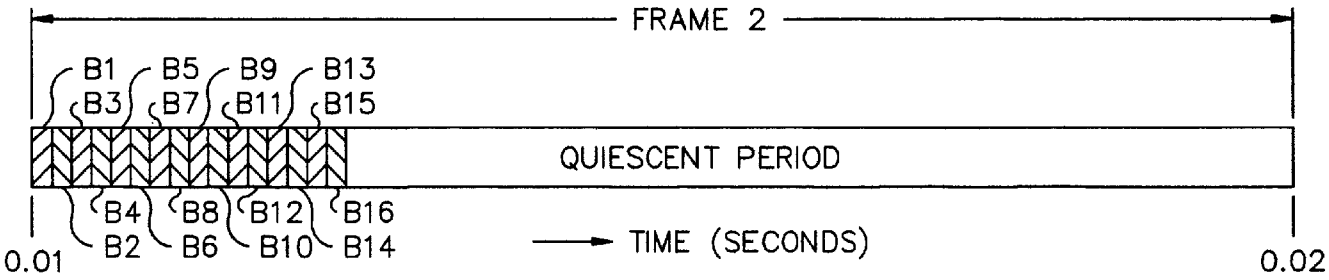
FIG. 2B is a timing diagram illustrative of the frame signal structure utilized by the first preferred embodiment of the present invention.
Figure 2C:
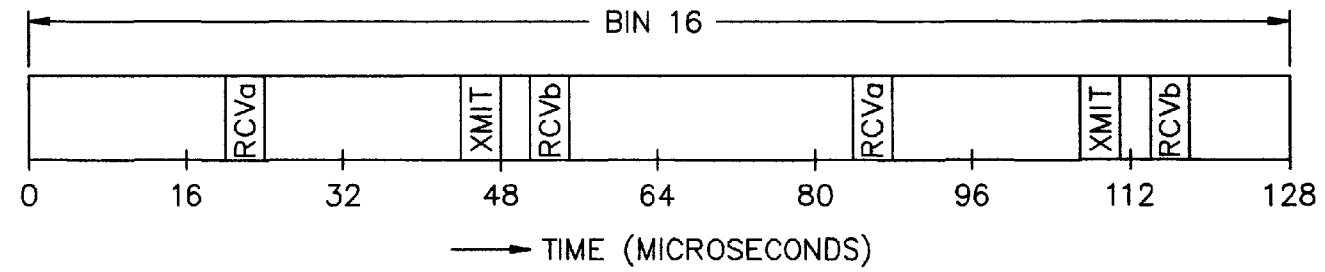
FIG. 2C is a timing diagram illustrative of the bin signal structure utilized by the first preferred embodiment of the present invention.

As shown in FIG. 2B, each frame interval includes 16 bins, B1 through B16, and a quiescent period. As further shown in FIG. 2C, each bin includes two RF burst transmission periods (XMIT), two noise receiving periods (RCVA), and two signal receiving durations (RCVB), the timing of the transmitting and receiving being controlled by PLD 56. The transmission and receiving frequencies during each bin period are identical and are determined by a plurality of predetermined numbers in a frequency lookup table, FLUT, stored in the PROM 50. As shown in FIG. 3, table FLUT consists of nine columns of 16 numbers each, the contents of column 1 corresponding to the bin numbers 1 through 16 and the contents of each of columns 2–9 being a set of numbers $\{C_k\}$ corresponding to the transmission/receiving frequencies of the EAS system 10. During each frame interval, transmitter 20 transmits thirty-two, six microsecond RF bursts during the 16 bin periods. Each burst is transmitted twice per bin with the frequency of each bin being selected by sequentially drawing numbers from a single set $\{C_k\}$ stored in the table FLUT, the set of numbers, $\{C_k\}$, being selected according to the group address signal. The DSP 52 converts the numbers drawn from table FLUT to the actual frequency control words used for tuning the DCFS 22. In the first embodiment, the frequency of the first bin period is about 8.7 MHZ. The frequency of the next bin period in time sequence is about 70 KHz lower and so on until sixteen frequencies are transmitted, thus spanning a frequency range from about 8.7 MHZ to about 7.6 MHZ. during each frame interval duration. Preferably, as shown in FIG. 2B, the bins are positioned at the beginning of each frame. However, as will be appreciated by those skilled in the art, the individual bins could be positioned anywhere within each frame and still be within the spirit and scope of the invention. Further, the number of RF bursts, the specific frequencies of the RF bursts and the order in which the frequencies of the RF bursts are transmitted are not critical to the invention provided that the frequency span of the RF bursts is sufficient to cover the uncertainty of the resonant frequency of the security tag 42 and the frequency spacing of the RF bursts is sufficiently small to locate the resonant frequency of the security tag 42 with acceptable reliability.

In the first preferred embodiment, the duration of the individual frame intervals are not equal but are made to vary over the superframe repetition period such that for a particular EAS system, the frame interval durations are selected according to the group address signal to be different from the frame interval durations of other EAS systems, resulting in the EAS system 10 being substantially free of false alarms or blockages caused by the operation of other EAS systems. For a valid detection of a security tag 42 to occur, the second electromagnetic signal (radiated from the tag 42) must be detected by the receiver 24 at the same receiving frequency (or frequencies) in at least three consecutive frames. Because there is only a very small probability that the RF bursts from one EAS system 10 will occur during the same three or more receiving intervals of another EAS system 10, there is no need to synchronize co-located EAS systems 10 for the purpose of mitigating RF interference. Therefore, the EAS system 10 does not transmit or receive synchronizing or other signals for the purpose of preventing false alarms or receiver blockage.

In the first preferred embodiment, the controller 12 includes a maximum length pseudo-noise sequence generator (PNSG), an output of which changes once each frame interval. In the first preferred embodiment, the PNSG is modeled by the DSP 52 of the controller 12 by simulating an eight stage linear shift register having a repetition period of 255 frames, the PNSG repetition period constituting the superframe repetition period. The shift register employs predetermined feedback connections to determine the PNSG output pattern. Preferably, the specific feedback connections are determined by the contents of a frame look up table, JLUT, stored in the PROM 50. In the first embodiment, table JLUT consists of nine columns, the contents of column 1 corresponding to the shift register stage numbers from which PNSG feedback connections are made and columns 2–9 corresponding to the feedback connections selected according to the group address signal. The specific feedback connections for the eight stage PNSG used in the first embodiment are shown in FIG. 4.

The output of the PNSG is an eight bit number formed by the composite of the binary output of each shift register stage. Each frame interval duration is determined by adding the shift register output to a nominal frame duration value. Since the output of a PNSG does not repeat over a repetition period, 255 different frame interval duration values are created over the repetition period of the pseudo-noise generator. In the first preferred embodiment, the nominal frame interval duration is about 0.01 seconds and each binary bit of the pseudo-noise generator represents eight microseconds resulting in the frame interval duration varying from about 9000 to 11000 microseconds in eight microsecond increments over a superframe repetition period. As will be appreciated by those skilled in the art, the present invention is not limited to using a linear shift register generator for generating the pseudo-random number stream nor is the number stream limited to 255 numbers. For example, the frame durations could be determined from a table lookup and the numbers in the table derived from any number of standard random number generation means and still be within the spirit and scope of the invention. Further, the nominal frame duration period and the time increments represented by the shift register output are not limited to 0.01 seconds and 8 microseconds respectively.

Figure 5:
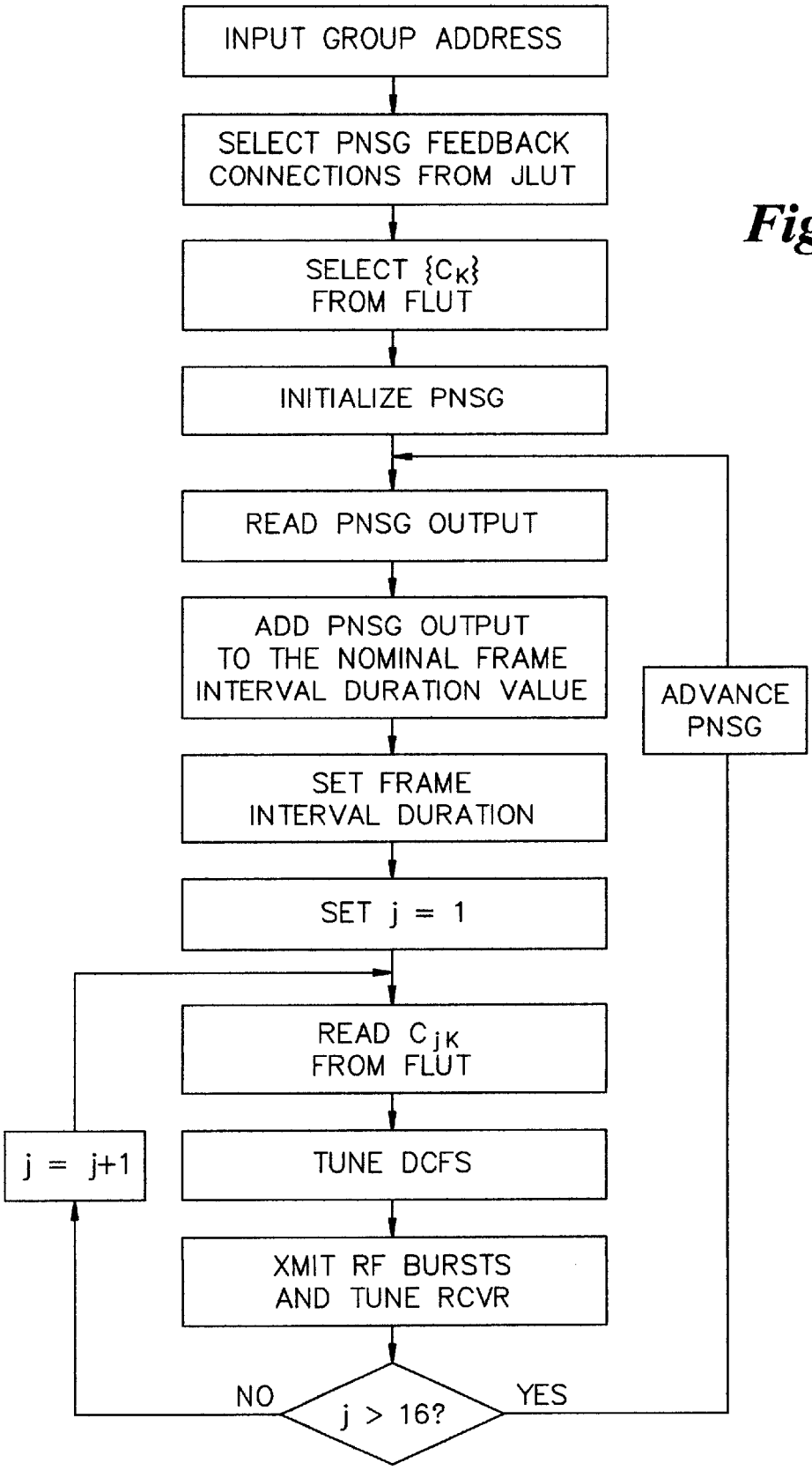
FIG. 5 is a flow diagram describing the control of transmission and reception frequency and time according to the first preferred embodiment of the present invention.

FIG. 5 is a self explanatory flow diagram describing the generation of the superframe, frame, bin and the transmitter/receiver control signals of the first preferred embodiment The specific set of PNSG feedback connections to be used in the first preferred embodiment of EAS system 10 is determined by the group address signal. In the first preferred embodiment, the group address signal originates from the group address selector 36, comprising a set of switches (not shown) mounted on each EAS system 10. In a location where a plurality of EAS systems 10 are in use, it would be common to use a different group address for each EAS system 10 to prevent interference between the EAS systems 10. As will be appreciated by those skilled in the art, the group address need not be entered from switches mounted on the EAS system 10 but could be entered from a keypad or similar entry device or could be entered from a remote location via telephone lines or other communication medium and still be within the spirit and scope of the invention.

Figure 6A:
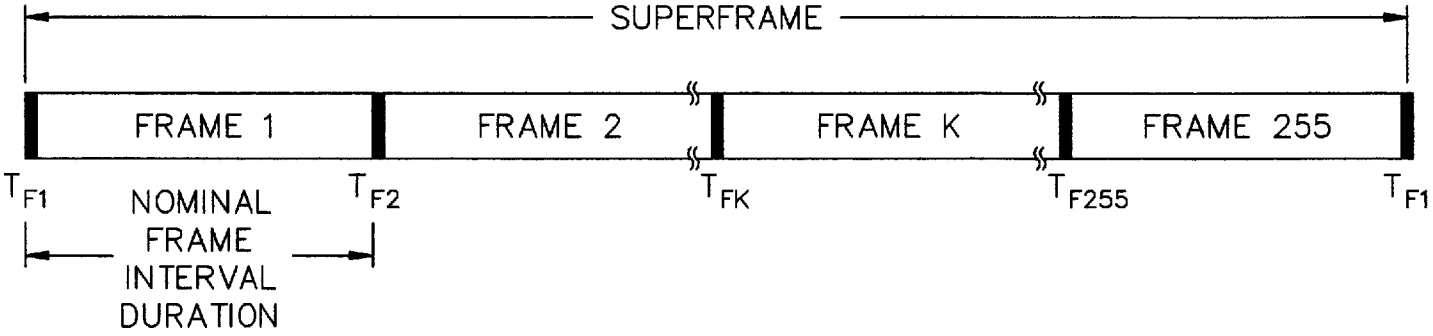
FIG. 6A is a timing diagram illustrative of the superframe signal structure utilized by a second preferred embodiment of the present invention.
Figure 6B:
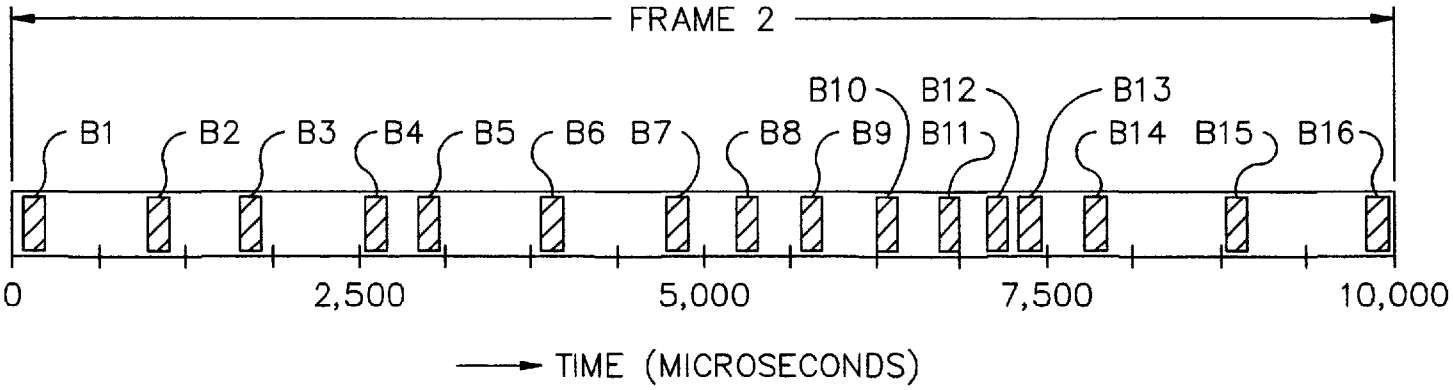
FIG. 6B is a timing diagram illustrative of the frame signal structure utilized by the second preferred embodiment of the present invention.

FIGS. 6A and 6B are timing diagrams of a second preferred embodiment of the EAS system 10 in which the frame interval durations are fixed at one value (see FIG. 6A) and the separations between the RF burst positions (bins) within a frame are variable (see FIG. 6B) in contrast to the first preferred embodiment in which the frame interval durations are variable over a superframe repetition period and the separations between the RF bursts positions within a frame are fixed in value. The configuration of the second preferred embodiment of the EAS system 10 is identical to the configuration of the first preferred embodiment shown in FIG. 1. The second preferred embodiment differs from the first embodiment by: (1) employing a pulse look up table PLUT (to be described) instead of table JLUT to determine the transmitter and receiver timing and (2) the numbers stored in the frequency look up table FLUT are determined by an explicit process as described following.

In the second preferred embodiment, the eight sets of predetermined numbers $\{C_k\}$ stored in frequency lookup table FLUT (see FIG. 3) are permutations of a single, predetermined ordered set $\{S\}$ of L non-repeating, non-negative integer numbers where L equals sixteen and the numbers in set $\{S\}$ range from 0 to 15. The numbers in each of the ordered sets, $\{C_k\}$, derived from permuting the set $\{S\}$, are arranged so that no more than two identical numbers occupy the same position in the different ordered sets $\{C_k\}$. In the second preferred embodiment, the frequency of each RF burst and the corresponding frequency of the receiver 24 in each respective bin over the frame interval is determined by sequentially drawing all the numbers, in order, from one of the sets $\{C_k\}$ during each frame interval according to the selected group address. The same set of frequencies is repeated each frame interval. As will be appreciated by those skilled in the art, the set $\{S\}$ need not be limited to 16 numbers but may be greater or less than sixteen. Further, the number sets $\{C_k\}$ are not required to be derived from the permutations of a single number set but may be derived by any suitable means providing that the individual number sequences display the sought for matching properties between the number sets.

In the second preferred embodiment, the positions of the RF burst, noise receiving period and signal receiving period within a bin period are identical to the first embodiment. However, the separation of each bin relative to other bins within each frame interval is not fixed as in the first embodiment but is determined by the same number drawn from the number set $\{C_k\}$ as is used for determining the transmission and receiving frequencies of the EAS system 10. Preferably, the times $T_{jk}$, separating the start of each bin from the starting time of each frame interval are determined according to the equations 1–3 as follows:

$$T_1=1 \text{ for } j=1 \tag{1}$$

$$T_{jk}=T_{j-1,k}+\Delta t+C_{jk}\cdot R_t \text{ for } j=2, 3 \ldots L \tag{2}$$

where:

$T_1$=the separation time of the first bin from the frame interval start;

$T_{jk}$=the separation time of the jth bin from the j−1 bin for the number set $C_k$;

$\Delta t$ =the bin width;

$C_{jk}$=the value of the jth integer in the kth number set $\{C_k\}$; and $$R_t=(T_t-(L\cdot\Delta t))/\Sigma j \tag{3}$$

where j=1 to L−1, and where $T_t$ is the frame interval duration of the t-th frame interval.

In the second preferred embodiment, the values of $T_{jk}$ are predetermined by equations 1–3 and are subsequently stored in table PLUT (shown in FIG. 7), residing in PROM 50. Since there are eight different group addresses, and since the frame interval duration is fixed, $T_t$ (equation 3) is a constant equal to nominal frame interval duration. Accordingly, table PLUT stores eight sets of sixteen bin starting times $T_{jk}$. FIG.

Figure 8:
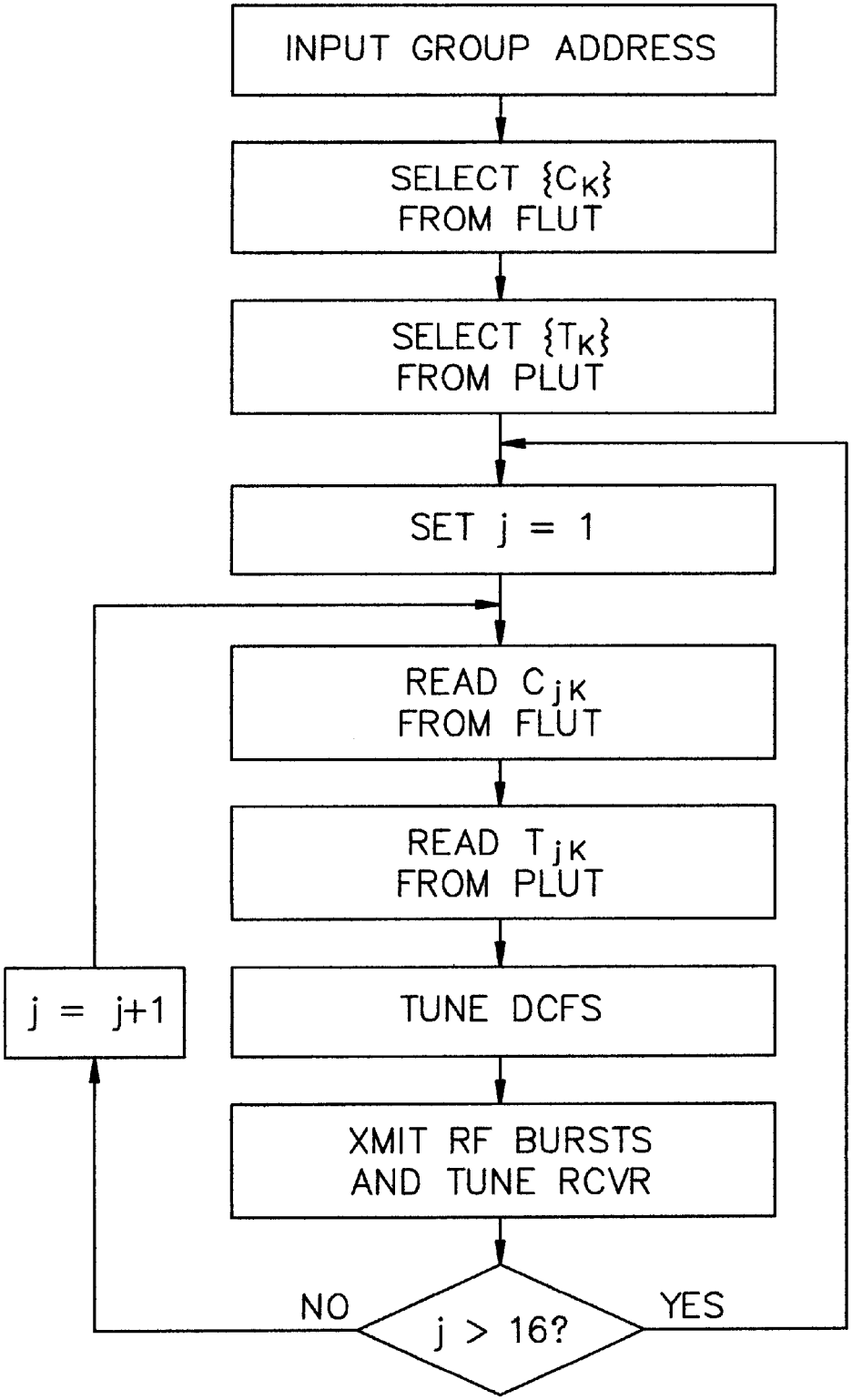
FIG. 8 is a flow diagram describing the control of the transmission and reception frequency and time according to the second preferred embodiment of the present invention.

6B shows the placement of the bins B1–B16 within a frame for a frame duration of 0.01 seconds and a number set $\{C_k\}=\{0, 15, 7, 11, 5, 10, 13, 6, 3, 9, 4, 2, 1, 8, 12, 14\}$. FIG. 8 is a is self explanatory flow diagram describing the generation of the frame, bin and the transmitter/receiver control signals of the second preferred embodiment.

Figure 9:
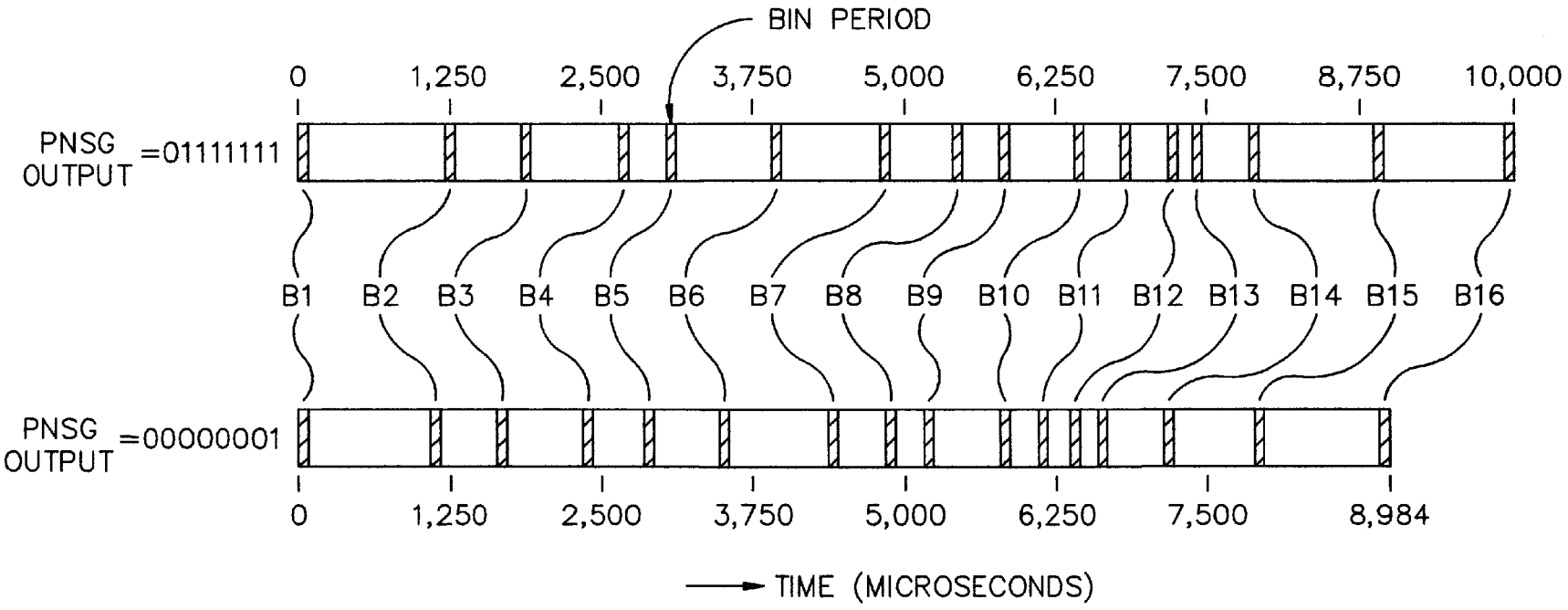
FIG. 9 is a timing diagram illustrative of the bin positions within frames of different frame interval durations in accordance with a third preferred embodiment of the present invention.
Figure 10:
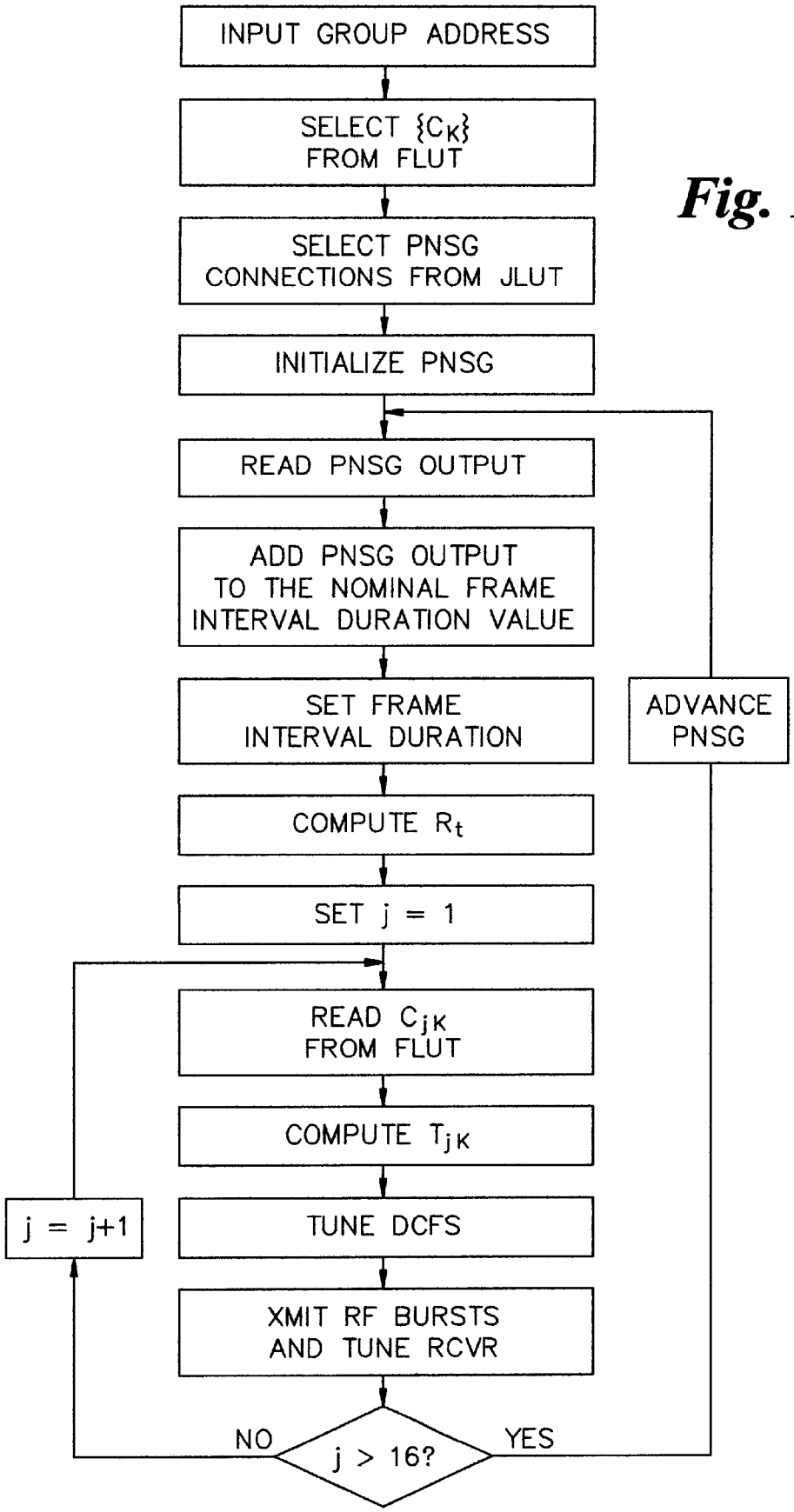
FIG. 10 is a flow diagram describing the control of the transmission and reception frequency and time according to the third preferred embodiment of the present invention.

A third preferred embodiment of the present invention is a composite of the first and second embodiments and utilizes the identical configuration of the first preferred embodiment, shown in FIG. 1. In the third preferred embodiment, eight number sets $\{C_k\}$ are predetermined and stored in the frequency look up table FLUT and eight sets of feedback connections for the pseudo-noise generator are predetermined and stored in the frame look up table JLUT. The position, $T_{jk}$, of each bin is determined according to equations 1–3. However, since the duration, $T_t$, of each frame interval varies in accordance with the PNSG output, which changes with each frame, the factor $R_t$, in equation (2) also varies for each frame. Preferably, the positions, $T_{jk}$, of each bin in each frame are calculated by solving equation (2) in the DSP 52 in real time for each frame. By making a new calculation of bin position for each frame, the separations of the bins vary relative to each other from frame to frame over a superframe repetition period adding additional randomness to the signal structure compared to the first and second embodiments. It will be appreciated by those skilled in the art that the bin positions, $T_{jk}$, could be determined by table look-up as well as by computation. In that case, for 255 different possible frame interval durations, the pulse look up table PLUT would store 255×16×8=32,640 different bin positions. Referring to FIG. 9, there is shown the bin structure of two frames within the same superframe having frame interval durations of 10,000 and 8984 microseconds respectively thereby demonstrating the additional bin time randomness introduced by the third embodiment. FIG. 10 is a self explanatory flow diagram describing the generation of the superframe, frame, bin and the transmitter/receiver control signals of the third preferred embodiment.

A fourth preferred embodiment utilizes the configuration shown in FIG. 1 and is similar in operation to embodiment three in that both the frame interval durations and the bin positions are varied on a frame by frame in accordance with both each frame interval duration and the number set $\{C_k\}$. However, in the fourth embodiment, the output of the PNSG (and thus the frame interval durations) is quantized into a predetermined number of subdivided ranges, each subdivided range having a value equal to the midpoint of the respective sub-divided range, the value of $T_t$ for each frame being selected to be the value of one of the sub-divided ranges such that the difference between the respective frame interval duration and the value of the selected sub-divided range is less than a predetermined value.

In the fourth preferred embodiment, computational requirements in the DSP 52 are reduced to hashing the output of the PNSG into one of the sub-divided ranges, the actual bin positions being determined on a frame by frame basis by the contents of pulse look up table PLUT. In the fourth embodiment there are eight sub-divided ranges corresponding to a frame interval duration of 256 microseconds for each. The bin positions $T_{jk}$ resulting from quantizing $T_t$, and as determined by equation (2), are stored in table PLUT. Since, there are eight values of $R_t$ and 128 values $C_{jk}$ (eight sets of sixteen values) there is a total of 1024 bin positions, $T_{jk}$, stored in the pulse look up table PLUT.

A fifth preferred embodiment is another composite of the first and second embodiments and utilizes the identical configuration of the first preferred embodiment, shown in FIG. 1. In the fifth preferred embodiment, eight number sets $\{C_k\}$ are stored in table FLUT and eight sets of feedback connections for the pseudo-noise generator are stored in table JLUT. The position, $T_{jk}$, of each bin is determined according to equations 1–3. However, instead of computing the bin positions for each frame interval, the frame interval duration, $T_t$, used to calculate $R_t$ in equation (2) is fixed, and equal to the minimum frame duration value. Thus in the fifth embodiment, the bin positions are identical from frame to frame. Preferably, the bin positions constitute eight sets of sixteen numbers and are stored in pulse look up PLUT, table look up being more efficient than computation by DSP 52. However, as will be apparent to those skilled in the art, the computation of the bin positions could be performed by the DSP 52 within the spirit and scope of the invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A pulse-listen electronic article security (EAS) system for detecting the presence of a security tag within a detection zone comprising:

a transmitter for radiating a first electromagnetic signal into the detection zone, the first electromagnetic signal being a time sequence of RF bursts emitted during each of a plurality of contiguous frame intervals, a duration of each of the frame intervals being one of a plurality of different values; and a receiver synchronized with the transmitter for receiving a second electromagnetic signal re-radiated from a security tag in the detection zone in response to the first electromagnetic signal and providing an output signal if a security tag is detected, wherein the values of the plurality of the frame interval durations are selected to be different from the values of frame interval durations of other EAS systems thereby rendering the EAS system substantially free of false alarms or blockages caused by the operation of other EAS systems.

2. The pulse-listen electronic article security (EAS) system according to claim 1 wherein there is no intended communication between the EAS system and other EAS systems.

3. The pulse-listen EAS system according to claim 1 further including a controller having a maximum length pseudo-noise sequence generator an output of which changes once each frame interval wherein the value of each frame interval duration is determined by combining the output of the maximum length pseudo-noise sequence generator with a nominal frame interval duration value, the sequence generator output being determined by a plurality of predetermined feedback connections, a specific connection being selected according to a group address.

4. The pulse-listen EAS system according to claim 3 wherein the sequence generator has a repetition period of about 255 frames.

5. The pulse-listen EAS system according to claim 3 wherein the value of the nominal frame interval duration is about 0.01 second.

6. A pulse-listen electronic article security (EAS) system for detecting the presence of a security tag within a detection zone comprising:

a transmitter for radiating a first electromagnetic signal into the detection zone, the first electromagnetic signal being a time sequence of RF bursts, the frequency of the bursts being a plurality of values transmitted during each of a plurality of contiguous frame intervals, each frame interval comprising a sequence of bins each of which includes at least one RF burst, a noise receiving period, and a signal receiving period, each bin having a beginning and an end, the beginning of each successive bin being separated in time from the end of the previous bin by a plurality of values, the beginning of a first bin in each frame interval occurring at a predetermined time relative to a starting time of each frame interval; and a receiver synchronized to the transmitter to be operative only during the noise receiving period and the signal receiving period of each bin for receiving a second electromagnetic signal re-radiated from a security tag in the detection zone in response to the first electromagnetic signal and providing an output signal if a security tag is detected, wherein a combination of the plurality of the burst frequencies and the bin separations is selected to be different from a combination of other burst frequencies and bin separations of other EAS systems thereby rendering the EAS system substantially free of false alarms or blockage caused by the operation of other EAS systems.

7. The pulse-listen electronic article security (EAS) system according to claim 6 wherein there is no intended communication between the EAS system and other EAS systems.

8. The pulse-listen EAS system according to claim 6 further including a controller connected to the transmitter and the receiver for determining the burst frequencies, the bin separations and a frame interval duration, the controller storing M sets of numbers $\{C_k\}$, k ranging in value from 1 to M, each set of numbers $\{C_k\}$ being a different permutation of a single ordered set $\{S\}$ consisting of L non-repeating non-negative integer numbers, the numbers in each set $\{C_k\}$ being arranged so that no more than two identical numbers occupy the same position in the different ordered sets $\{C_k\}$.

9. The pulse-listen EAS system according to claim 8 wherein the frequency of each burst in each frame interval is determined by sequentially selecting the numbers in order from one of the set of numbers $\{C_k\}$ according to a group address, all of the numbers of the set $\{C_k\}$ being selected during each frame interval.

10. The pulse-listen EAS system according to claim 9 wherein a position of each bin in each frame interval is determined by sequentially selecting the numbers in order from one of the set of numbers $\{C_k\}$ according to the group address, all of the numbers of the set $\{C_k\}$ being selected during each frame interval, the bin positions being determined so that no more than one bin will overlap the position of another bin when different group addresses are selected.

11. The pulse-listen EAS system according to claim 10 wherein the times $T_{jk}$, separating the start of each bin from the starting time of each frame interval are determined according to the following relationship:

$$T_1=1 \text{ for } j=1$$

$$T_{jk}=T_{j-1,k}+\Delta t+C_{jk}\cdot R \text{ for } j=2, 3 \ldots L$$

where:

$T_1$=the separation time of the first bin from the frame interval start;

$T_{jk}$=the separation time of the jth bin from the j−1 bin;

$\Delta t$=the bin width;

$C_{jk}$=the value of the jth integer in the kth number set $\{C_k\}$; and $R=(T_t-(L\cdot\Delta t))/\Sigma j$ for j=1 to L−1, where $T_t$ is the frame interval duration.

12. The pulse-listen EAS system according to claim 10 wherein the number set $\{S\}$ comprises at least 16 numbers.

13. A pulse-listen electronic article security (EAS) system for detecting the presence of a security tag within a detection zone comprising:

a transmitter for radiating a first electromagnetic signal into the detection zone, the first electromagnetic signal being a time sequence of RF bursts, the frequency of the bursts being a plurality of values transmitted during each of a plurality of contiguous frame intervals, a duration of each of the frame intervals being one of a plurality of values, each frame interval comprising a sequence of bins which includes at least one RF burst, a noise receiving period, and a signal receiving period, each bin having a beginning and an end, the beginning of each successive bin being separated in time from the end of the previous bin by a plurality of values, the beginning of a first bin in each frame interval occurring at a predetermined time relative to a starting time of each frame interval; and a receiver synchronized to the transmitter to be operative only during the noise receiving period and the signal receiving period of each bin for receiving a second electromagnetic signal re-radiated from a security tag in the detection zone in response to the first electromagnetic signal and providing an output signal if a security tag is detected, wherein a combination of the plurality of the burst frequencies, the bin separations and the frame interval durations is selected to be different from a combination of other burst frequencies, bin separations and frame interval durations of other EAS systems thereby rendering the EAS system substantially free of false alarms or blockage caused by the operation of other EAS systems.

14. The pulse-listen electronic article security (EAS) system according to claim 13 wherein there is no intended communication between the EAS system and other EAS systems.

15. The pulse-listen EAS system according to claim 13 further including a controller connected to the transmitter and the receiver for determining the burst frequencies, the bin separations and the frame interval durations, the controller storing M sets of numbers $\{C_k\}$, k ranging in value from 1 to M, each set of numbers $\{C_k\}$ being a different permutation of a single ordered set $\{S\}$ comprising L non-repeating non-negative integer numbers, the numbers in each set $\{C_k\}$ being arranged so that no more than two identical numbers occupy the same position in the different ordered sets $\{C_k\}$.

16. The pulse-listen EAS system according to claim 15 wherein the number set $\{S\}$ comprises at least 16 numbers.

17. The pulse-listen EAS system according to claim 15 wherein the frequency of each burst in each frame interval is determined by sequentially selecting the numbers in order from one of the set of numbers $\{C_k\}$ according to a group address, all of the numbers of the set $\{C_k\}$ being selected during each frame interval.

18. The pulse-listen EAS system according to claim 17 wherein a position of each bin in each frame interval is determined by sequentially selecting the numbers in order from one of the set of numbers $\{C_k\}$ according to the group address, all of the numbers of the set $\{C_k\}$ being selected during each frame interval, the bin positions being determined so that no more than one bin will overlap the position of another bin when different group addresses are selected.

19. The pulse-listen EAS system according to claim 18 wherein the times $T_{jk}$, separating the start of each bin from the starting time of each frame interval are determined for each frame according to the following relationship:

$$T_1=1 \text{ for } j=1$$

$$T_{jk}=T_{j-1,k}+\Delta t+C_{jk}\cdot R_t \text{ for } j=2, 3 \ldots L$$

where:

$T_1$=the separation time of the first bin from the frame interval start;

$T_{jk}$=the separation time of the jth bin from the j−1 bin;

Δt=the bin width;

$C_{jk}$=the value of the jth integer in the kth number set $\{C_k\}$; and $R_t=(T_t-(L\cdot\Delta t))/\Sigma j$ for j=1 to L−1, where $T_t$ is the value of the t-th frame interval duration.

20. The pulse-listen EAS system according to claim 18 wherein the times $T_{jk}$, separating the start of each bin from the starting time of each frame interval are determined for each frame according to the following relationship:

$$T_1=1 \text{ for } j=1$$

$$T_{jk}=T_{j-1,k}+\Delta t+C_{jk}\cdot R_t \text{ for } j=2, 3 \ldots L$$

where:

$T_1$=the separation time of the first bin from the frame interval start;

$T_{jk}$=the separation time of the jth bin from the j−1 bin;

Δt=the bin width;

$C_{jk}$=the value of the jth integer in the kth number set $\{C_k\}$; and $R_t=(T_t-(L\cdot\Delta t))/\Sigma j$ for j=1 to L−1, wherein the range between a maximum and a minimum of the plurality of frame interval duration values is divided into a predetermined number of sub-divided ranges, each sub-divided range having a value equal to the midpoint of the respective sub-divided range, the value of $T_t$, for the t-th frame interval being selected to be the value of one of the sub-divided ranges such that the difference between the respective frame interval duration and the value of the selected sub-divided range is less than a predetermined value.

21. The pulse-listen EAS system according to claim 18 wherein the times $T_{jk}$, separating the start of each bin from the starting time of each frame interval are determined according to the following relationship:

$$T_1=1 \text{ for } j=1$$

$$T_{jk}=T_{j-1,k}+\Delta t+C_{jk}\cdot R \text{ for } j=2, 3 \ldots L$$

where:

$T_1$=the separation time of the first bin from the frame interval start;

$T_{jk}$=the separation time of the jth bin from the j−1 bin;

Δt=the bin width;

$C_{jk}$=the value of the jth integer in the kth number set $\{C_k\}$; and $R=(T_t-(L\cdot\Delta t))/\Sigma j$ for j=1 to L−1, where $T_t$ is a minimum of the plurality of frame interval duration values.

22. The pulse-listen EAS system according to claim 17 wherein the duration of each frame interval is determined by an output of a maximum length pseudo-noise sequence generator which changes value each frame interval, the sequence generator output being combined with a nominal frame interval duration value, the sequence generator output being determined by a plurality of predetermined feedback connections, a specific connection being selected according to the group address.

23. The pulse-listen EAS system according to claim 22 wherein the sequence generator has a repetition period of at least 255 frames.

* * * * *